US007126488B1

(12) United States Patent
May

(10) Patent No.: US 7,126,488 B1
(45) Date of Patent: Oct. 24, 2006

(54) METHOD AND APPARATUS USED IN COMBINATION FOR INSTALLING A BLOWN FUSE INDICATOR LIGHT WITHIN A PRE-EXISTING FUSE HOUSING

(76) Inventor: Galen J. May, 7630 Tholl Dr., Reno, NV (US) 89506

( * ) Notice: Subject to any disclaimer, the term of this patent is extended or adjusted under 35 U.S.C. 154(b) by 48 days.

(21) Appl. No.: 11/090,853

(22) Filed: Apr. 2, 2005

Related U.S. Application Data

(60) Provisional application No. 60/558,603, filed on Apr. 1, 2004.

(51) Int. Cl.
*G08B 21/00* (2006.01)

(52) U.S. Cl. ..... 340/638; 340/691.1; 340/693.5; 324/505; 324/550; 337/241; 337/242; 337/265

(58) Field of Classification Search ..... 340/638, 340/691.1, 693.5; 324/505, 550; 337/241, 337/242, 265
See application file for complete search history.

(56) References Cited

U.S. PATENT DOCUMENTS 5,874,884 A * 2/1999 Hull et al. ..... 337/241
6,448,897 B1 * 9/2002 Ku ..... 340/638

* cited by examiner

*Primary Examiner*—Tai Nguyen

(57) ABSTRACT

Herein provided is a method and apparatus that allows a pre-existing fuse housing to be easily modified and adapted to include a blown fuse indicator light thereon. Whereby when the fuse housing and light in combination are installed within an electrical circuit and if the fuse is no longer functional, the light will automatically illuminate so as to visually notify a user that the fuse needs to be replaced. Also, any suitable light source may be used, such as an LED, a cartridge type having end contacts, a long lasting reusable incandescent lamp, fiber optics, neon, etc.

2 Claims, 1 Drawing Sheet

METHOD AND APPARATUS USED IN COMBINATION FOR INSTALLING A BLOWN FUSE INDICATOR LIGHT WITHIN A PRE-EXISTING FUSE HOUSING

RELATED APPLICATION

This application is derived from my provisional application No. 60/558,603, which was filed on Apr. 1, 2004 in the name of the current inventor. It is to be noted no new material has been entered. The application as presented herein has just been re-formatted to comply with PTO regulations.

FIELD OF THE INVENTION

The present invention pertains to methods and/or improvements connected with a prior art plug-in type fuse having a fusible internal link but more particularly relates to an improvement incorporating use of an indicator light that automatically illuminates when actuated by the blown fuse when a circuit overload has occurred.

BACKGROUND OF THE INVENTION

Many types of circuit protectors and/or fuses exist and various types of indicator lights have been taught in the past, yet such devices have not been successfully marketed or produced. It is therefore contended that it would be useful to teach a method for modifying an existing prior art plug-in type fuse that would allow a user to easily modify the fuse housing in a manner so as to be functional as a fuse having a blown fuse indicator light as well. Combinations of fuses having an indicator light have been taught within the known prior art. However, such devices or combinations are very limited and have not proven to be cost effective for manufacturing, nor are they easily marketable.

Some examples of the known prior art include U.S. Pat. Nos. 6,448,897, 5,701,118, 5,874,884 and 5,598,138 all of which address a proposed combination for a plug-in type fuse having a blown fuse indicator light therewith. However, both the '897 and '118 references are much too costly and complicated and are also very bulky and difficult to install. The '884 reference is also functional but is limited in use because of size and again manufacturing costs, etc. The '138 reference is also functional but includes use of two lights and is not easily installed. Most importantly, none of the cited references and/or known prior art provide or address use of a different type of light, such as a typical cartridge type light having metal contacts on its ends. Another type of light that would be most advantageous is a typical incandescent lamp type. The later is most desirable as it can be easily replaced and reused, and also has an extremely long life span, such as 100,000 hours. Thus, the present invention is most useful, very advantageous, cost effective, and addresses and resolves problems associated within the prior art in a manner heretofore not taught.

SUMMARY OF THE INVENTION

It is therefore an important object of the present invention to provide a method for installation of an indicator light for use with any standard type plug-in fuse housing and the light when installed is automatically actuated when an electrical circuit overload has occurred and thus visually informs the user that the fuse needs to be replaced.

It is another object of the present invention to provide a method for installation of an indicator light for use with any standard type plug-in fuse housing and the light can be either installed within the electrical fuse housing after market by the consumer, or it can easily be incorporated at the point of manufacture depending on engineering and end user choice.

It is a very important object of the present invention to provide a method of installation for an indicator light for use with any standard type plug-in fuse housing that provides most unusual results and quickly visually notifies the user that an electrical overload has occurred. It is to be understood that such fuses are normally installed in multiples and it is very difficult to determine which of the electrical fuses have been overloaded. This is especially evident when the mounting panel is positioned in a darkened area, in a vehicle, or during the nighttime. In such a situation it can be extremely difficult and irritating when one is searching for the blown fuse. Thus the present invention eliminates the guesswork for the user as well as saves time and wasted energy.

Still a further object of the present invention is to provide a method for installation of an indicator light for use with any standard type plug-in fuse housing that can be any suitable light means of engineering choice. For example, such suitable light means includes but is not limited to a pre-existing light source, such as a light emitting diode "LED", cartridge type having end contacts, long lasting reusable incandescent lamp, or even fiber optics, or neon, may be utilized, etc.

Yet another object of the present invention is to provide a method for installation of an indicator light for use with any standard type plug-in fuse housing that is economical to manufacture and easily marketable. Also, the present invention is most suitable for use with standard fuse housings that are made from conductive plastics.

Other objects and advantages will be seen when taken into consideration with the following specification and drawings.

DETAILED DESCRIPTION OF THE DRAWINGS

Figure 1:
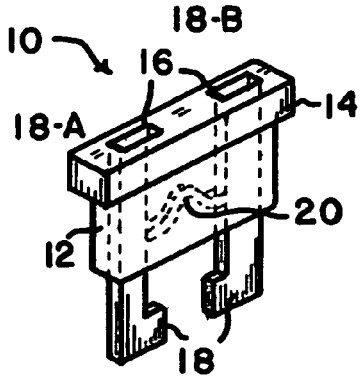
FIG. 1 substantially represents a perspective overview of a standard prior art plug-in type fuse before being modified using the present method.

Referring now in detail to the drawings wherein like numerals represent like elements throughout the various views, in FIG. 1, arrow (10) is substantially an overview of a typical prior art plug-in type fuse as commonly found within most vehicle electrical circuits and the like. Such prior art fuses include a fuse housing (12) that is typically made from a colored plastic material, with the color being indicative of the current rating of the fuse so as to signify amperage thereof, and includes a generally rectangular top wall (14) that has a pair of longitudinally spaced terminal access openings (16) that extend through top wall (14) into the interior of fuse housing (12).

Positioned within housing (12) and extending from the opposite end of housing (12) from top wall (14) are a pair of parallel, spaced, blade-type fuse terminals (18) that are adapted to be received within a correspondingly spaced pair of fuse receptacle contacts within a plastic fuse block, or the like (not shown). Fuse terminals (18) have a length sufficient for them to extend outwardly from the lower end of housing (12), and also to extend into housing (12) to be received and tightly held by the housing by suitable terminal anchoring arrangements (not shown). Extending between each of fuse terminals (18) within fuse housing (12) is a fusible link (20) that is made from a material that permits the passage between fuse terminals (18) of currents less than the rated current value of the fuse, and that will melt or separate if a current greater than the rated current value of the fuse passes through the fusible link (20).

The prior art fuse (10) when installed within an electrical circuit allows the fuse housing (12) to be partially exposed and the fuse (10) when installed within an electrical circuit has a first and a second exposed terminal tab, (18A) & (18B) that lie within terminal access openings (16) within the fuse housing (12).

It is to be understood the circuit overload indicator light of the present invention can be installed in multiple ways and some of the possible installation methods will be addressed hereafter. However, the invention is not to be limited to such installation methods but is to include other types of methods that may become applicable over time.

As previously noted many different types of suitable circuit overload indicators lights may be incorporated depending on engineering choice. For example, the light may be a light emitting diode "LED", cartridge type light having end contacts, a long lasting reusable incandescent lamp, fiber optics or neon, may be utilized, etc. Thus, the following installation methods and apparatus's as illustrated herein are only exemplary of some suitable methods and light source alternatives.

Figure 2:
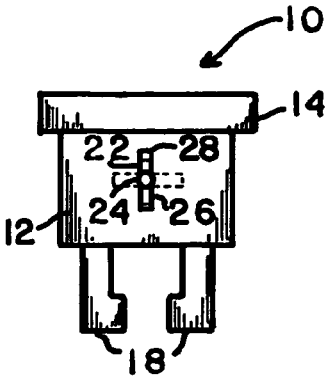
FIG. 2 substantially depicts a frontal view for a first embodiment including a first blown fuse indicator light when installed within the housing of a standard plug-in type fuse after being modified using the present method.

Referring now in detail to the first embodiment and installation method as illustrated and taught within FIG. 2. As can be seen therein, either the end user or a machinist at the point of manufacture manually cuts and forms a vertical aperture (22) at a location of choice between fuse terminals (18) within fuse housing (12) thus forming a keyway. The aperture (22) when formed being of a shape and size to slidably removably receive and accept a blown fuse indicator light (24) and it's light housing (26) therein. In the preferred first embodiment the blown fuse indicator light (24) is in the form of a reusable incandescent lamp and its associated circuitry are contained within a light housing (26). The actual components pertaining to the light and it's construction are not taught herein as such knowledge is very well known and taught within the electrical field.

The light housing (26) is formed into a shape and size that allows for a mating relationship within aperture (22) including an elongated base portion having a first end and a second end that are opposed to each other. Each end includes a metal contact member (28) that is of a type according to engineering choice fixedly attached thereon. As can be seen, light housing (26) due to it's shape and size can be easily aligned and inserted into aperture (22), hereinafter referred to as the install position. Thereafter the user can easily manually rotate light housing (26) into its locked position, with the latter being shown in ghost lines. Thus, when the base portion of light housing (26) is rotated into the noted locked position, metal contact members (28) are urged into contact with fuse terminals (18) resulting in electrical communication between metal contact members (28) and fuse terminals (18) when fuse (10) is energized and functioning. It is to be noted that if needed, metal contact members (28) may further include engagement means (not shown) which further urges metal contact members (28) into contact with fuse terminals (18), such as in the form of a spring or the like.

Whereby, when fuse (10) is functioning and is installed within an electrical circuit, blown fuse indicator light (24) will not illuminate. However, upon an electrical overload resulting in melting of fusible link (20), which in turn interferes with the electrical circuit, indicator light (24) automatically illuminates so as to visually notify a user that the fuse is no longer functional and needs to be replaced. This embodiment is very advantageous as this type of indicator light that has a very long life can be easily installed yet easily removed as well and is thereby usable within other fuses if needed.

As now understood, the assembly and method steps for the above embodiment include:

a. grasping the fuse housing (12) of a prior art fuse (10);
b. cutting and forming an elongated vertical aperture (22) within fuse housing (12);
c. grasping a blown fuse indicator light (24);
d. positioning blown fuse indicator light into an install position, by aligning blown fuse indicator light (24) with elongated vertical aperture (22);
e. inserting blown fuse indicator light (24) into elongated vertical aperture (22);
f. rotating blown fuse indicator light (24) into a horizontal locked position; and;
g. installing prior art fuse (10) with blown fuse indicator light (24) within an electrical circuit in the typical manner;

whereby:

when a circuit overload has occurred and prior art fuse is no longer functional, blown fuse indicator light automatically illuminates and visually notifies a user that the fuse needs to be replaced.

Figure 3:
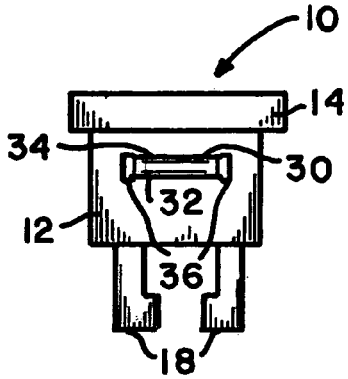
FIG. 3 substantially depicts a frontal view for a second embodiment including a second blown fuse indicator light when installed within the housing of a standard plug-in type fuse after being modified using the present method

Referring now in detail to the second embodiment and installation method as illustrated and taught within FIG. 3. As can be seen therein, either the end user or a machinist at the point of manufacture manually cuts and forms a horizontal aperture (30) at a location of choice between fuse terminals (18) within fuse housing (12). The aperture (30) when formed being of a shape and size to frictionally slidably removably receive and accept a blown fuse indicator light (32) and it's light housing (34) therein. In this embodiment the blown fuse indicator light (32) is in the form of a light with its associated circuitry being contained within a cartridge type light housing (34). The actual components pertaining to the light and it's construction are not taught herein as such knowledge is very well known and taught within the electrical field.

The cartridge type light housing (34) as formed is of a shape and size that allows for a mating relationship within horizontal aperture (30) when installed therein and cartridge type light housing (34) provides a first end and a second end that are opposed to each other. Each end includes a metal contact member (36) that is of a type according to engineering choice fixedly attached thereon. As can be seen, cartridge type light housing (34) due to it's shape and size can be easily aligned and inserted into horizontal aperture (30), and is frictionally retained in position by a snap fit, respectively. Thus, when the cartridge type light housing (34) is installed, metal contact members (36) are urged into contact with fuse terminals (18) resulting in electrical communication between metal contact members (36) and fuse terminals (18) when fuse (10) is energized and functioning. It is to be noted that if needed, metal contact members (36) may further include engagement means (not shown) which further urges metal contact members (36) into contact with fuse terminals (18), such as in the form of a spring or the like.

Whereby, when fuse (10) is functioning and is installed within an electrical circuit, blown fuse indicator light (32) will not illuminate. However, upon an electrical overload resulting in melting of fusible link (20), which in turn interferes with the electrical circuit, indicator light (32) automatically illuminates so as to visually notify a user that the fuse is no longer functional and needs to be replaced.

As now understood, the assembly and method steps for the second embodiment include:

a. grasping the fuse housing (12) of a prior art fuse (10);

b. cutting and forming an elongated horizontal aperture (30) within fuse housing (12);

c. grasping cartridge type light housing (34);

d. positioning cartridge type light housing (34) into an install position, by aligning cartridge type light housing (34) with elongated horizontal aperture (30);

e. inserting or frictionally snapping cartridge type light housing (34) into elongated horizontal aperture (30); and;

f. installing prior art fuse (10) with cartridge type light housing (34) within an electrical circuit in the typical manner;

whereby:

when a circuit overload has occurred and prior art fuse is no longer functional, cartridge type light housing automatically illuminates and visually notifies a user that the fuse needs to be replaced.

Although the invention has been herein shown and described in what is conceived to be the most practical and preferred embodiments, it is recognized that departures may be made there from within the scope and spirit of the invention, which is not to be limited to the details disclosed herein but is to be accorded the full scope of the specification and claims so as to embrace any and all equivalent devices and apparatus.

What I claim and wish to secure by Letters Patent is:

1. A method for installing a cartridge light housing having a blown fuse indicator light therein into a pre-existing fuse housing comprising the method steps of:

a. grasping the fuse housing of a prior art fuse;

b. cutting and forming an elongated horizontal aperture within said fuse housing;

c. grasping said cartridge light housing;

d. positioning said cartridge light housing into an install position, by aligning said cartridge light housing with said elongated horizontal aperture;

e. inserting or frictionally snapping said cartridge light housing into said elongated horizontal aperture;

and;

f. installing prior art fuse (10) with cartridge type light housing (34) within an electrical circuit in the typical manner;

whereby:

when a circuit overload has occurred and the prior art fuse is no longer functional, said cartridge light housing automatically illuminates and visually notifies a user that said prior art fuse needs to be replaced.

2. In combination a pre-existing fuse housing and a blown fuse indicator light comprising: a pre-existing fuse housing having a generally rectangular top wall including a pair of longitudinally spaced apart terminal access openings that extend through said generally rectangular top wall into the interior of said pre-existing fuse housing, positioned within said longitudinally spaced apart terminal access openings within said pre-existing fuse housing are a pair of parallel spaced apart blade type fuse terminals that extend outwardly from a lower end of said pre-existing housing opposite said generally rectangular top wall, said pair of parallel spaced apart blade type fuse terminals having a fusible link there between, said pre-existing fuse housing having a horizontal aperture formed therein between said pair of parallel spaced apart blade type fuse terminals, said blown fuse indicator light is contained within a cartridge light housing, said light housing including an elongated base portion having a first end and a second end that are opposed to each other, each said end having a metal contact member, said horizontal aperture being of a shape and size to slidably removably receive and frictionally accept said blown fuse indicator light with said cartridge light housing when inserted therein and each said metal contact member are urged into contact with said fuse terminals when installed resulting in electrical communication between said metal contact members and said fuse terminals, whereby:

upon an electrical overload resulting in melting of said fusible link, said indicator light automatically illuminates so as to visually notify a user that the fuse is no longer functional and needs to be replaced.

* * * * *